US012075872B2

(12) United States Patent
Leatherman

(10) Patent No.: US 12,075,872 B2
(45) Date of Patent: Sep. 3, 2024

(54) ADJUSTABLE HAT

(71) Applicant: LML Headwear, LLC, Derby, KS (US)

(72) Inventor: Lacie Leatherman, Mulvane, KS (US)

(73) Assignee: LML Headwear, LLC, Derby, KS (US)

( * ) Notice: Subject to any disclaimer, the term of this patent is extended or adjusted under 35 U.S.C. 154(b) by 403 days.

(21) Appl. No.: 16/774,580

(22) Filed: Jan. 28, 2020

(65) Prior Publication Data

US 2021/0227915 A1 Jul. 29, 2021

(51) Int. Cl.
*A42B 1/22* (2006.01)

(52) U.S. Cl.
CPC ..... *A42B 1/22* (2013.01)

(58) Field of Classification Search
CPC ..... A42B 1/22; A42B 1/00; A42B 1/225; A42B 7/00; A42C 5/00; A42C 5/02; Y10S 2/918
USPC ..... 2/195.2, 195.3, 195.4, 183, 171, 195.1, 2/175.1, 918, DIG. 11
See application file for complete search history.

(56) References Cited

U.S. PATENT DOCUMENTS

| | | | | |
|---|---|---|---|---|
| 1,575,291 | A | 3/1926 | Trau | |
| D170,970 | S | 12/1953 | D'Arbeloff | |
| D193,969 | S | 11/1962 | Lawson | |
| D299,380 | S | 1/1989 | Wang | |
| D314,857 | S | 2/1991 | Vossler | |
| D324,193 | S | 2/1992 | Wen-Long | |
| 5,099,524 | A * | 3/1992 | Linday | A41D 20/00 2/10 |
| D342,595 | S | 12/1993 | Day | |
| 5,887,289 | A * | 3/1999 | Theoret | A42B 1/08 2/195.1 |
| 6,049,911 | A * | 4/2000 | Bromberg | A42B 1/22 2/12 |
| 6,941,581 | B1 * | 9/2005 | England | A42B 1/22 2/195.2 |
| D556,330 | S | 11/2007 | Auerbach et al. | |
| D578,740 | S | 10/2008 | Schussleder et al. | |
| 9,119,708 | B2 | 9/2015 | Wanderer et al. | |

(Continued)

FOREIGN PATENT DOCUMENTS

KR 20070016702 A * 2/2007

*Primary Examiner* — Jameson D Collier
*Assistant Examiner* — Matthew R Marchewka
(74) *Attorney, Agent, or Firm* — Stinson LLP

(57) ABSTRACT

An adjustable hat includes a covering and an adjustable fastener including first and second fastening elements that can releasably fasten together by snap fit connection at a plurality of discrete positions. The first fastening element defines an attachment hole adjacent to an end portion remote from the second fastening element. An elastic strap affixed to the covering extends through the attachment hole and loops around the end portion of the first fastening element to connect the first fastening element to the covering such that the elastic strap permits the entire first fastening element to move relative to the covering by elastic elongation of the elastic strap. The hat can be free of stitching which passes through any portion of the first fastening element. The first fastening element can be male or female. Moreover, both fastening elements can be elastically connected to the covering via respective attachment holes and elastic straps.

19 Claims, 6 Drawing Sheets

(56) References Cited

U.S. PATENT DOCUMENTS

| | | | | |
|---|---|---|---|---|
| D753,375 | S | 4/2016 | Singleterry | |
| D761,924 | S | 7/2016 | Sato | |
| D763,552 | S | 8/2016 | Lin | |
| D770,148 | S | 11/2016 | Hwang | |
| D770,733 | S | 11/2016 | Hwang | |
| D771,914 | S | 11/2016 | Cho | |
| 9,763,486 | B2 | 9/2017 | Lacy et al. | |
| D800,991 | S | 10/2017 | Gordon | |
| D838,941 | S | 1/2019 | Leatherman | |
| 2003/0233696 | A1 | 12/2003 | Lee | |
| 2004/0045075 | A1 | 3/2004 | Yan | |
| 2004/0187191 | A1* | 9/2004 | Lee | A42B 1/22 2/171 |
| 2007/0061944 | A1 | 3/2007 | Briskie | |
| 2014/0053317 | A1* | 2/2014 | Haroutoonian | A42B 1/22 2/195.3 |
| 2016/0021961 | A1 | 1/2016 | Lacy et al. | |
| 2019/0133231 | A1* | 5/2019 | Stark | A42B 7/00 |

* cited by examiner

ADJUSTABLE HAT

FIELD

The present disclosure generally relates to a hat with an adjustable fastener.

BACKGROUND

Hats with adjustable fasteners are in wide use. For example, adjustable baseball cap-style hats include a covering, a bill that projects from the front of the covering, and an adjustable fastener on a rear portion of the covering. The covering and the fastener together form a rim portion of the hat that is configured to extend circumferentially around the head of the wearer. The fastener can be selectively adjusted to adjust the size of the rim portion in relation to the head of the wearer. Visors can have similar constructions except that the coverings stop short of the top of the wearer's head. Many types of adjustable fasteners are used to selectively size hats.

One well-known type of adjustable fastener is a snapping fastener. A conventional snapping fastener includes male and female fastening elements that can releasably couple together by snap fit connection at any of a plurality of discrete locations to selectively size the hat for a given wearer. Each fastening element comprises a strap of flexible material with a set of integral snap formations. Each fastening element has a free end portion and an opposite end portion that is sewn directly into the covering fabric. The male and female fastening elements extend lengthwise toward one another from the sewn-in end portions. The female fastening element includes a set of sockets, and the male fastening element includes a set of studs that are configured to be matingly received in any of the sockets. The sockets and studs are equally spaced along the length of the respective fastening element. As such, the wearer can overlap free end segments of the male and female fastening elements along a desired length, which corresponds with a certain number of consecutive studs and sockets. The wearer connects the respective subsets of studs and sockets along the desired lengths of overlapped free end segments to fasten the adjustable fastener and set the desired size of the hat.

Expandable hats are also known. For example, it is known to form a segment of the rim portion of the hat from elastic material to allow a certain degree of elastic expansion of the rim portion.

SUMMARY

In one aspect, an adjustable hat comprises a covering for covering a portion of a head of a wearer. An adjustable fastener is connected to the covering. The adjustable fastener comprises first and second fastening elements configured to be releasably fastened together at any of a plurality of positions to adjust a size of the adjustable hat. The first fastening element has a free end portion and an opposite end portion. The first fastening element defines an attachment hole adjacent the opposite end portion. An elastic strap is affixed to the covering. The elastic strap extends through the attachment hole and loops around the opposite end portion of the first fastening element to connect the first fastening element to the covering such that the elastic strap permits the first fastening element to move relative to the covering by elastic elongation of the elastic strap.

In another aspect, an adjustable hat comprises a covering for covering a portion of a head of a wearer. An adjustable fastener comprises first and second fastening elements configured to be selectively fastened together at any of a plurality of positions. The first fastening element is formed from a single piece of monolithic material. The first fastening element has a free end portion and an opposite end portion. The first fastening element defines an attachment hole adjacent to the opposite end portion. A strap is affixed to the covering. The strap extends through the attachment hole and loops around the opposite end portion of the first fastening element to connect the first fastening element to the covering.

In another aspect, an adjustable hat comprises a covering for covering a portion of a head of a wearer. An adjustable fastener comprises first and second fastening elements configured to be selectively fastened together at any of a plurality of positions. The first fastening element has a free end portion and an opposite end portion. An elastic strap connects the opposite end portion of the first fastening element to the covering such that the elastic strap permits the first fastening element to move relative to the covering by elastic elongation of the elastic strap. The adjustable hat is free of stitching which passes through any portion of the first fastening element.

Other aspects will be in part apparent and in part pointed out hereinafter.

BRIEF DESCRIPTION OF THE DRAWINGS

Corresponding parts are given corresponding reference numbers throughout the drawings.

DETAILED DESCRIPTION

Figure 1:
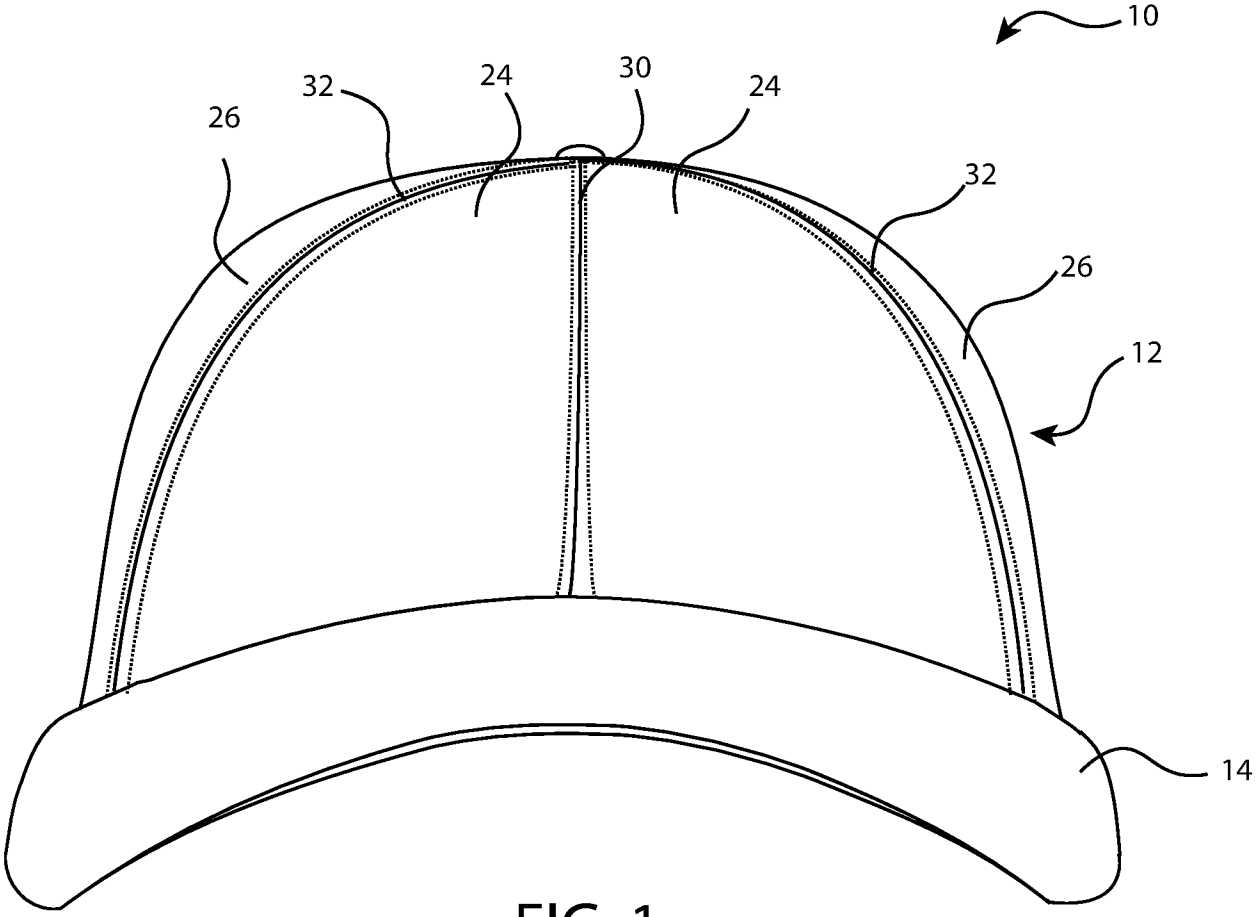
FIG. 1 is a front elevation of an adjustable hat.
Figure 2:
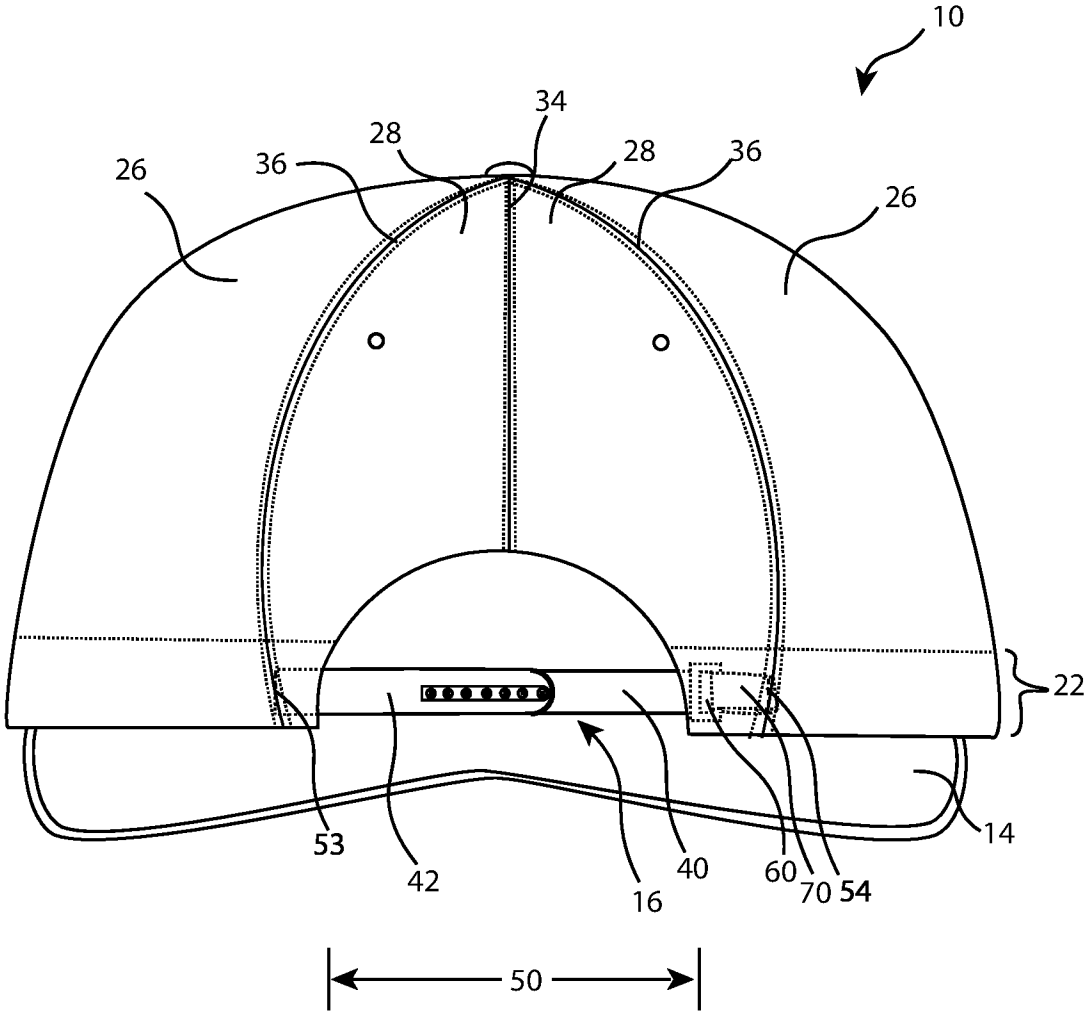
FIG. 2 is a rear elevation of the hat showing certain interior components in broken line.

Referring to FIGS. 1 and 2, an embodiment of an adjustable hat within the scope of this disclosure is generally indicated at 10. In the illustrated embodiment, the adjustable hat 10 is in the style of an adjustable baseball cap. Thus, broadly speaking, an adjustable hat 10 within the scope of one or more embodiments of the present disclosure comprises a covering 12, a bill 14 connected to a front portion of the covering, and an adjustable fastener 16 connected to a rear portion of the covering. As will be explained in further detail below, the illustrated adjustable fastener 16 is elastically connected to the covering 12 to allow a certain amount of expansion of the adjustable hat 10 after the adjustable fastener 16 is fastened.

The covering 12 has an interior and an exterior. When the adjustable fastener 16 is fastened, the covering 12 and the adjustable fastener together define a rim portion 22 of the hat 10 configured to extend around the perimeter of a wearer's head. In an embodiment, at least a portion of the interior of the covering 12 is configured to contact and generally conform to a portion of the head of the wearer. The exterior of the covering 12 faces outwardly and may be emblazoned with a design or insignia of some sort or may be substantially plain colored. In the illustrated embodiment, the covering 12 includes a top portion extending up from the rim portion 22 configured to cover the top of a wearer's head. It will be understood, however, that in other embodiments the adjustable hat can be a visor that comprises a covering comprising a rim portion for extending around the wearer's head, but which lacks a top portion to cover the top of the wearer's head. For the purpose of this disclosure, a hat can broadly include a shaped covering for a part of the head.

Referring still to FIGS. 1-2, the illustrated covering 12 includes first and second front panels 24, first and second side panels 26, and first and second back panels 28. The panels 24, 26, 28 are affixed together to form the covering 12. More particularly, the illustrated first and second front panels 24 are joined together along a front seam 30. Each front panel 24 is also joined to one of the side panels 26 along a respective front-side seam 32. The first and second back panels 28 are joined together along a back seam 34. Each back panel 28 is also joined to one of the side panels 26 along a respective back-side seam 36. The bottom edge margins of the panels 24, 26, 28 define part of the rim portion 22 in one or more embodiments. Although the illustrated covering 12 shown in FIGS. 1-2 comprises a plurality of panels 24, 26, 28 joined together along respective seams 30, 32, 34, 36, it will be understood the other hats could comprise coverings formed from other numbers and arrangements of panels (including coverings formed from a single panel) without departing from the scope of this disclosure.

Figure 3:
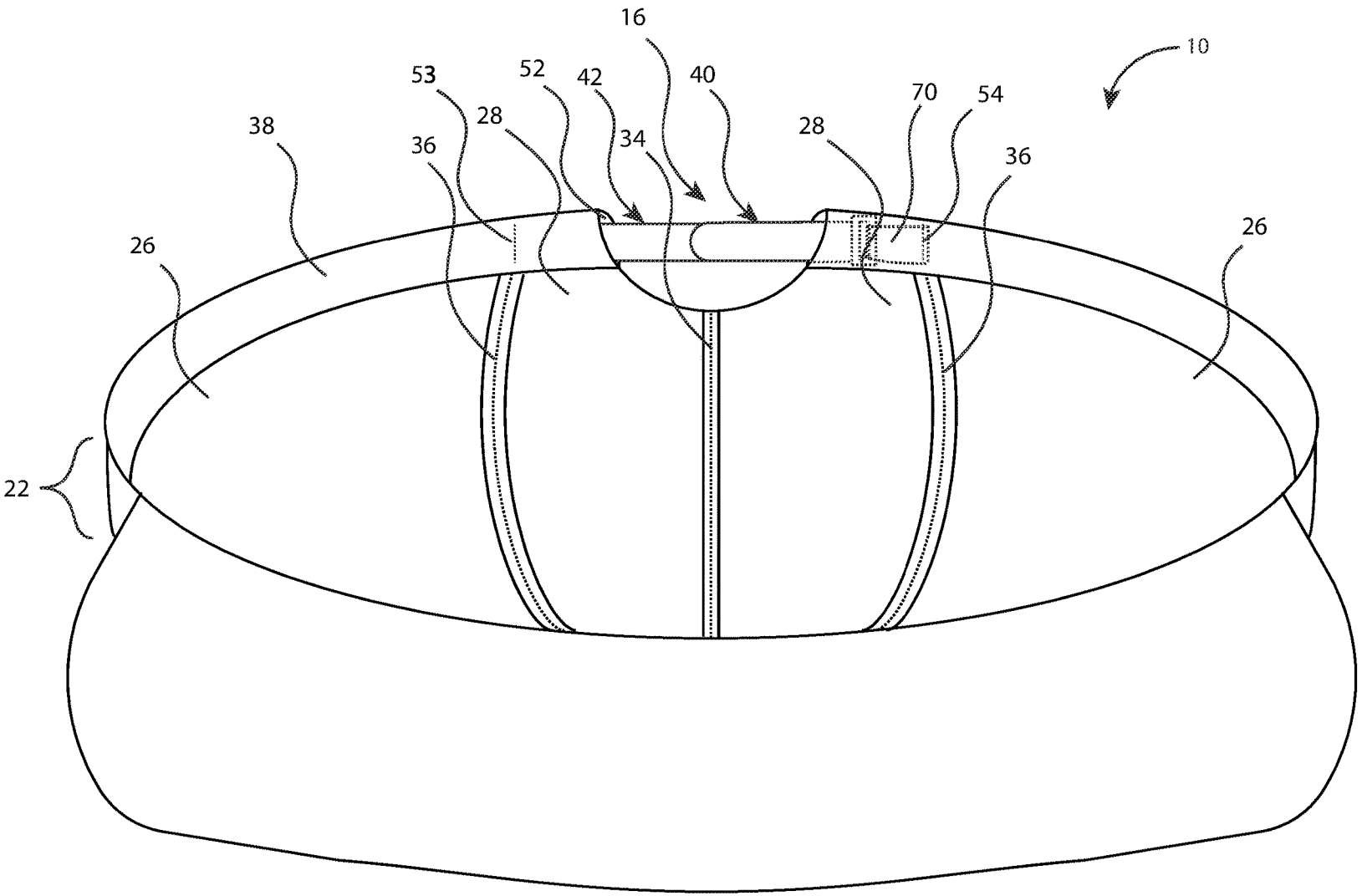
FIG. 3 is a bottom perspective of the hat showing certain covered components in broken line.

In an exemplary embodiment, the section of the rim portion 22 defined by the covering 12 is formed, in part, by bottom end portions of the panels 24, 26, 28 and, in part, by an interior sweatband 38, as illustrated in FIG. 3. The sweatband 38 may comprise a band of moisture absorbing material located inside the panels 24, 26, 28 and configured to contact the head of the wearer. The sweatband 38 comprises, in certain embodiments, a bottom edge margin secured to the bottom edge margins of the panels 24, 26, 28 and a free top edge margin that is unsecured to the panels. The sweatband 38 is arranged so that a pocket 52 is formed between the sweatband and the panels 24, 26, 28 along the rim portion 22.

In one or more embodiments, the bill 14 of the adjustable hat 10 is affixed to a front section of the rim portion 22 of the covering 12, e.g., the bill is affixed to the front panels 24, as best illustrated in FIGS. 1 and 3. As one who is skilled in the art would understand, the bill of an adjustable hat can be affixed to any part of the rim portion for stylistic or functional purposes. Such functional purposes may include, but are not limited to, protecting the user from ultra-violet sun rays.

Figure 4:
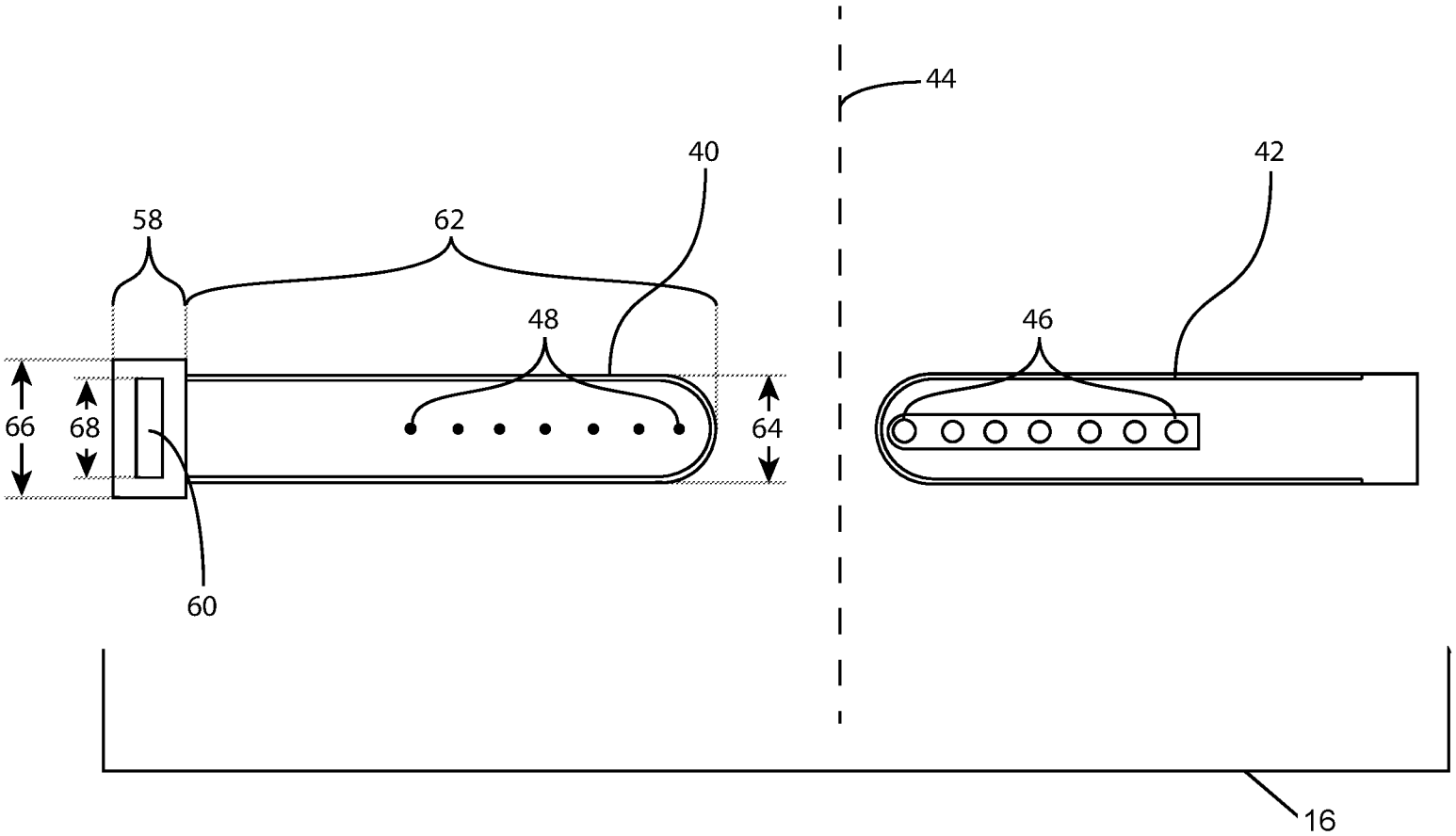
FIG. 4 is an exploded elevation of an adjustable fastener of the hat.
Figure 5:
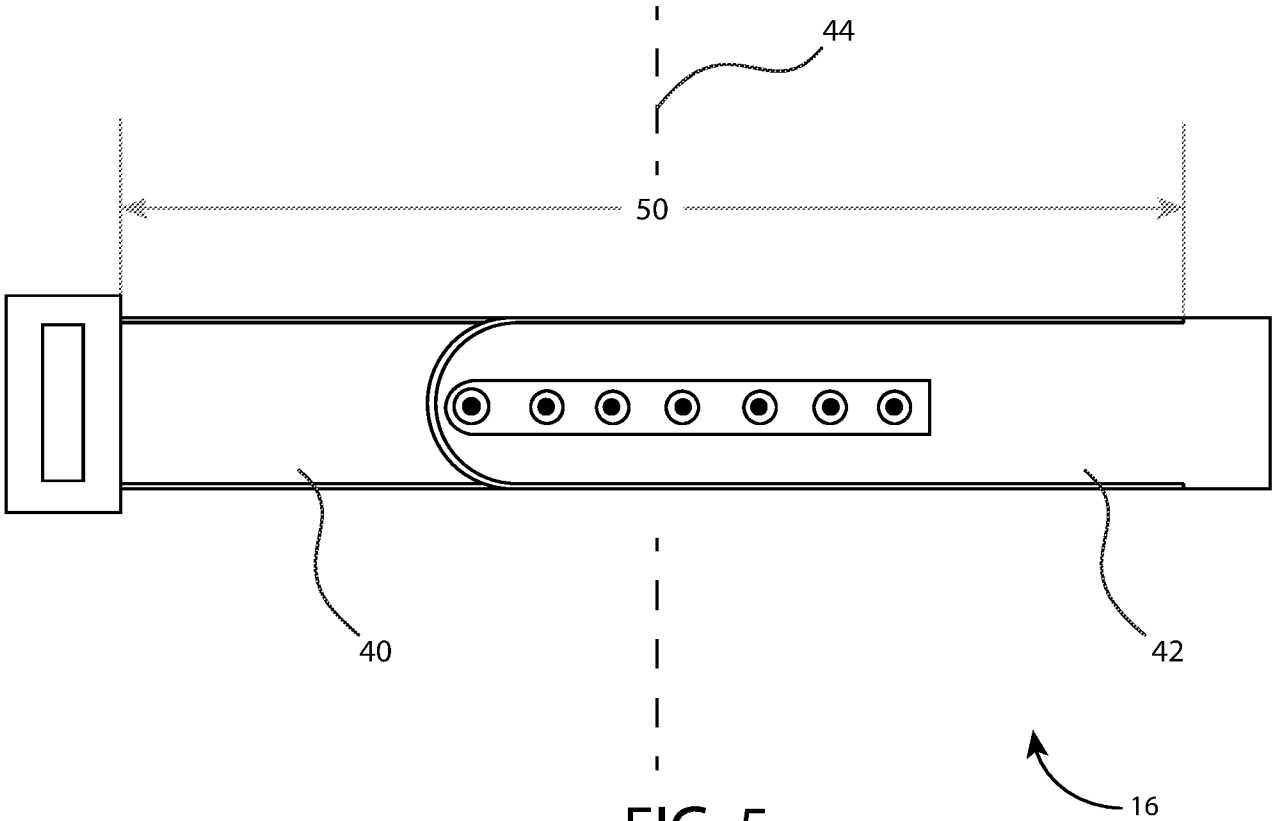
FIG. 5 is an elevation of the adjustable fastener showing male and female fastening elements thereof fastened together.

Referring to FIGS. 4 and 5, the illustrated adjustable fastener 16 comprises a snapping fastener with a male fastening element 40 and a female fastening element 42 (broadly, first and second fastening elements, wherein it is understood that either the male fastening element or the female fastening element can be considered a first fastening element or a second fastening element within the scope of this disclosure) that are configured to releasably couple together by snap-fit connection at any of a plurality of discrete positions, each generally corresponding to a respective hat size. It will be understood, however, that other types of adjustable fasteners may be used in one or more embodiments. Broadly speaking, adjustable fasteners within the scope of this disclosure comprise first and second fastening elements configured to releasably couple together at a plurality of positions corresponding to different hat sizes. In addition to the illustrated snapping fastener 16, it is contemplated that hats within the scope of the disclosure can fasten by way of dash-and-slot fastening elements, cable tie-type fastening elements, hook-and-loop fastening elements, button-type fastening elements, etc.

The illustrated female fastening element 42 includes a free end portion (e.g., the left end portion in FIG. 4), an opposite end portion (e.g., the right end portion in FIG. 4), and opposite longitudinal edge margins spaced apart along a transverse axis 44 (e.g., upper and lower edge margins in FIG. 4). Each of the opposite longitudinal edge margins extends longitudinally from the free end portion to the opposite end portion. The female fastening element 42 further comprises at least one row of sockets 46 (broadly, snap formations) that are spaced apart longitudinally (e.g., equidistantly) along the female fastening element.

Like the female fastening element 42, the male fastening element 40 includes a free end portion (e.g., the right end portion in FIG. 4), an opposite end portion (e.g., the left end portion in FIG. 4), and opposite longitudinal edge margins spaced apart along a transverse axis 44 (e.g., upper and lower edge margins in FIG. 4). Again, the longitudinal edge margins of the male fastening element 40 each extend longitudinally from the free end portion to the opposite end portion thereof. The male fastening element 40 further comprises a row of studs 48 (broadly, snap formations) spaced apart longitudinally (e.g., equidistantly) along the male fastening element. As is known to those skilled in the art, the studs 48 are configured to releasably fasten to the sockets 46 by snap-fit connection at any of a plurality of positions to adjust an effective length 50 of the adjustable fastener 16, as best seen in FIGS. 2 and 5. This adjusts the size of the rim portion 22 to fit different head sizes. Those skilled in the art will appreciate that various stud and socket configurations are possible within the scope of this disclosure.

Referring to FIGS. 2 and 3, in the illustrated embodiment, the female fastening element 42 is coupled directly to the covering 12 in a conventional manner. That is, stitching 53 directly connects the female fastening element 42 to the covering 12. In one or more embodiments, the opposite end portion of the female fastening element 42 extends into the pocket 52 formed between the panels 24, 26, 28 and the sweatband 38 and is stitched conventionally within the pocket. That is, stitching thread extends back and forth through the thickness of the female fastening element 42 and the fabric of one or both of the sweatband 38 and one or more panels 24, 26, 28. Any other suitable manner for securing the female fastening element 42 to the covering 12 can be used without departing from the scope of the disclosure.

As will be explained in further detail below, the illustrated male fastening element 40 is connected to the covering 12 by an elastic connection that allows the entire fastening element 16 to be resiliently displaced with respect to the covering. The inventor has recognized that, since conventional snapping fasteners can only fasten together to make a limited number of discrete hat sizes, they may not provide the optimal fit for every potential wearer. Moreover, the inventor has discovered that conventional elastically expandable hats have a very narrow range of potential sizes and thus are only capable of fitting a small percentage of potential wearers. As will be explained in further detail below, the inventor has addressed these and other issues by enabling the male fastening element 40 to be connected to the covering 12 by an elastic connection. Moreover, as will be explained in further detail below, the illustrated male fastening element 40 can be secured to the covering 12 without stitching passing through any portion of the male fastening element, which is thought to enhance the manufacturability of the hat 10.

Although only the male fastening element 40 is (i) secured by an elastic connection and (ii) connected without direct stitching in the illustrated embodiment, it is expressly contemplated that in another embodiment only the female fastening element 42 is (i) secured by an elastic connection and/or (ii) connected without direct stitching; and in yet another embodiment, both the male fastening element and the female fastening element are (i) secured by elastic connections and/or (ii) connected without direct stitching.

Referring to FIGS. 2 and 4, the male fastening element 40 has an unconventional structure to facilitate an elastic connection between the male fastening element and the covering 12. In the illustrated embodiment, the male fastening element 40 is formed from a single piece of monolithic material (e.g., a single molded or stamped piece of flexible plastic). Referring in particular to FIG. 4, the illustrated male fastening element 40 comprises two continuous, integrally formed sections: (a) an attachment hole section 58 that defines the opposite end portion and an attachment hole 60 and (b) a fastening section 62 that defines the free end portion and the studs 48 (broadly, the snap formations). As will be explained in further detail below, the male fastening element 40 is configured to couple to the covering 12 via the attachment hole 60.

As illustrated in FIG. 4, the fastening section 62 has a height 64 along the transverse axis 44 between the opposite longitudinal edge margins, and the attachment hole section 58 has a height 66 that is slightly larger than the height of the fastening section. Thus, in the illustrated embodiment, the attachment hole section 58 is slightly enlarged in relation to the fastening section 62. However, it will be understood that the height 66 of the attachment hole section 58 can be the same as the height 64 of the fastening section 62 in one or more embodiments. Additionally, the attachment hole 60 defined within the attachment hole section 58 has a height 68 along the transverse axis 44. In one or more embodiments, the height 68 of the attachment hole 60 is greater than one-half of the height 64 of the fastening section 62. In an embodiment, the height 68 of the attachment hole 60 is about the same as the height 64 of the fastening section 62 (e.g., differs from the height of the fastening section by less than or equal to about 10% of the height of the fastening section). In addition, the height 68 of the attachment hole 60 is greater than the heights of each of the studs 48 and sockets 46 along the transverse axis 44.

Figure 6:
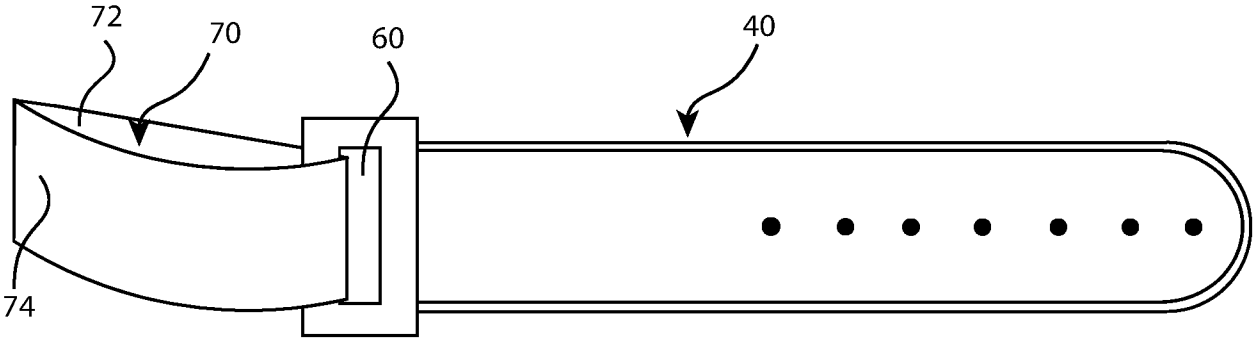
FIG. 6 is an elevation of a subassembly of the hat including the male fastening element and an elastic strap.

Referring FIGS. 2, 3, and 6, the adjustable hat 10 further includes an elastic strap 70 that is configured to connect the male fastening element 40 to the covering 12 via the attachment hole 60. The elastic strap 70 can be formed from any suitable resiliently stretchable material including, but not limited to, polyester, cotton, nylon, rubber, or a combination thereof. The elastic strap 70 includes a first end portion 72, a second end portion 74, and a length extending from the first end portion to the second end portion. In general, the elastic strap 70 is affixed to the covering 12 and the elastic strap extends through the attachment hole 60 and loops around the end portion of the fastening element 40 to connect the fastening element to the covering. It is contemplated that straps of non-elastic material could also be used to secure a fastening element to a hat covering in this manner within the scope of this disclosure.

In the illustrated embodiment, the elastic strap 70 extends through the attachment hole 60 and loops around the opposite end portion of the male fastening element 40 such that the second end portion 74 of the elastic strap 70 folds onto the first end portion 72 of the elastic strap 70. The overlapped end portions 72, 74 are both of affixed directly to the covering 12. More particularly, in the illustrated embodiment, the first and second end portions 72, 74 are stitched to the covering. During manufacturing, the first and second end portions 72, 74 can be stitched to the covering at the same time, using the same thread, in one or more embodiments. As such, in one or more embodiments, a contiguous length of stitching thread extends back and forth through each of the end portions of the elastic strap 70 and one or more layers of the covering. In the illustrated embodiment, the stitching 54 which affixes the elastic strap to the covering extends through the external panels of the hat 10 along one of the back-side seams 36. This substantially conceals the stitching 54 from view. It will be understood that the elastic strap could have other configurations in other embodiments. For example, in an embodiment, only the first end portion of the elastic strap is affixed directly to the covering, and the second end portion of the elastic strap is affixed to the first end portion after looping around the end portion of the fastening element. In certain embodiments affixing structure other than stitching (e.g., adhesive, snaps, rivets) may be used to affix the elastic strap to the covering. In one or more embodiments, the stitching or other affixing structure which affixes the elastic strap to the covering extends through the interior sweat band instead of the external panels.

Securing the fastening element 40 to the covering 12 via the attachment hole 60 and the elastic strap 70 enables the fastener 16 to move with respect to the covering after being fastened. That is, the elastic strap 70 can elastically stretch or elongate to allow displacement of the elastically connected fastening element 40 with respect to the covering 12, even after the male and female fastening elements 40, 42 have been fastened together. In one or more embodiments, the elastic strap 70 can elastically stretch or elongate to allow resilient displacement of the elastically connected fastening element 40 with respect to the covering 12 by a displacement distance of at least about 0.25 cm, e.g., at least about 0.50 cm, at least about 0.75 cm, at least about 1.0 cm, at least about 1.5 cm, at least about 2.0 cm, at least about 2.5 cm, or at least about 3.0 cm. This may enhance the fit or comfort of the hat in comparison with a conventional adjustable hat. Whereas a conventional adjustable hat is strictly limited to the discrete sizes associated with the positions at which the mating snap formations can be fastened together, the elastic connection provided by the strap 70 through the attachment hole 60 enables the rim portion 22 to expand to other sizes and more closely conform the head of the wearer.

Furthermore, a wearer can opt to fasten the fastening elements 40, 42 together in a slightly undersized configuration, and the elastic strap 70 will allow the rim portion 22 to expand sufficiently to fit the wearer's head. In this scenario, after the elastic strap 70 stretches to allow the hat 10 to be fitted to the wearer's head, it elastically rebounds, causing the rim portion 22 to positively gird the wearer's head. This may more firmly secure the hat to the wearer's head, which can be beneficial when wearing the hat in locations where wind or other conditions would otherwise tend to blow or force the hat off of the wearer's head.

Moreover, in one or more embodiments, the benefits of the elastic connection are achieved while concealing the existence of the elastic connection. Since the elastic strap 70 and the attachment hole section 58 of the fastening element 40 are hidden in the pocket 52 and the stitching 54 is hidden in a pre-existing seam 36, observers of the hat 10 cannot readily distinguish it from a conventional adjustable hat. Thus, the illustrated hat 10 provides many of the functional advantages of an elastic hat while providing a stylistic appearance that is essentially indistinguishable from a conventional adjustable hat.

Additionally, the provision of the attachment hole 60 in the monolithic fastening element 40 can simplify manufacturing in comparison with conventional adjustable fasteners. Whereas accommodations must be made to allow stitching to pass through the plastic of the fastening element in a conventional adjustable fastener, with the illustrated fastening element 40, stitching is only required to pass through layers of fabric, not plastic—e.g., the stitching 54 passes through only the fabric of the covering 12 and the fabric of the elastic strap 70.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products and methods without departing from the scope of the disclosure, it is intended that all matter contained in the above description shall be interpreted as illustrative and not in a limiting sense.

What is claimed is:

1. An adjustable hat comprising:

a covering for covering a portion of a head of a wearer;

an adjustable fastener connected to the covering, the adjustable fastener comprising first and second fastening elements, the first fastening element configured to be releasably fastened to the second fastening element at any of a plurality of positions along the second fastening element to adjust a size of the adjustable hat, the first fastening element having a free end portion and an opposite end portion, the first fastening element defining an attachment hole adjacent the opposite end portion; and an elastic strap disposed inside the covering such that the elastic strap is entirely covered by the covering, the elastic strap affixed to the covering, the elastic strap extending through the attachment hole and looping around the opposite end portion of the first fastening element to connect the first fastening element to the covering such that the elastic strap permits the first fastening element to move relative to the covering by elastic elongation of the elastic strap.

2. The adjustable hat of claim 1, wherein the first fastening element has opposite first and second longitudinal edge margins spaced apart along a transverse axis.

3. The adjustable hat of claim 2, wherein the first fastening element has a height along the transverse axis and the attachment hole has a height along the transverse axis, wherein the height of the attachment hole is greater than one-half of the height of the first fastening element.

4. The adjustable hat of claim 3, wherein one of the first and second fastening elements defines a plurality of prongs, each prong having a height along a transverse axis, the height of the attachment hole being greater than the height of each prong.

5. The adjustable hat of claim 2, wherein the first fastening element has an attachment hole section that defines the attachment hole and a fastening section that defines the free end portion, the attachment hole section and the fastening section having different heights along the transverse axis.

6. The adjustable hat of claim 2, wherein the attachment hole has a height along the transverse axis and a width perpendicular to the height, wherein the height is greater than the width.

7. The adjustable hat of claim 1, wherein the attachment hole has a rectangular shape.

8. The adjustable hat of claim 1, wherein the second fastening element has a free end portion and an opposite end portion, the second fastening element defining another attachment hole adjacent to the opposite end portion of the second fastening element, wherein the adjustable hat further comprises another elastic strap extending through the another attachment hole and looping around the opposite end portion of the second fastening element to connect the second fastening element to the covering.

9. The adjustable hat of claim 1, wherein the first fastening element is a male fastening element having a plurality of protrusions configured to fasten to the second fastening element.

10. The adjustable hat of claim 1, wherein the first fastening element is a female fastening element having a plurality of sockets configured to fasten to the second fastening element.

11. The adjustable hat of claim 1, wherein the covering comprises a plurality of exterior panels affixed at seams.

12. The adjustable hat of claim 11, wherein the elastic strap is affixed to the covering by stitching.

13. The adjustable hat of claim 12, wherein the stitching is along one of the seams.

14. The adjustable hat of claim 12, wherein the covering comprises an interior sweatband.

15. The adjustable hat of claim 1, wherein the elastic strap has a first end portion and a second end portion and each of the first and second end portions is affixed to the covering.

16. The adjustable hat of claim 15, wherein each of the first and second end portions of the elastic strap is affixed to the covering by stitching.

17. The adjustable hat as set forth in claim 1, wherein the first fastening element has an attachment hole section that defines the attachment hole and a fastening section that defines the free end portion, the attachment hole section being entirely covered by the covering.

18. An adjustable hat comprising:

a covering for covering a portion of a head of a wearer;

an adjustable fastener, the adjustable fastener comprising first and second fastening elements, the first fastening element configured to be selectively fastened to the second fastening element at any of a plurality of positions along the second fastening element, the first fastening element being formed from a single piece of monolithic material, the first fastening element having a free end portion and an opposite end portion, the first fastening element defining an attachment hole adjacent to the opposite end portion; and a strap disposed inside the covering such that the strap is entirely covered by the covering, the strap affixed to the covering, the strap extending through the attachment hole and looping around the opposite end portion of the first fastening element to connect the first fastening element to the covering.

19. An adjustable hat comprising:

a covering for covering a portion of a head of a wearer;

an adjustable fastener, the adjustable fastener comprising first and second fastening elements, the first fastening element configured to be selectively fastened to the second fastening element at any of a plurality of positions along the first fastening element, the first fastening element having a free end portion and an opposite end portion; and an elastic strap disposed inside the covering such that the elastic strap is entirely covered by the covering, the elastic strap connecting the opposite end portion of the first fastening element to the covering such that the elastic strap permits the first fastening element to move relative to the covering by elastic elongation of the elastic strap, wherein the adjustable hat is free of stitching which passes through any portion of the first fastening element.

* * * * *